US005697018A

United States Patent [19]

Thomas et al.

[11] Patent Number: 5,697,018

[45] Date of Patent: Dec. 9, 1997

[54] AIR HANDLING SYSTEM FOR A DEVELOPMENT HOUSING

[75] Inventors: Kim M. Thomas, Morrison, Colo.; Alvin D. Kromm, Jr., Webster, N.Y.

[73] Assignee: Xerox Corporation, Stamford, Conn.

[21] Appl. No.: 671,291

[22] Filed: Jun. 27, 1996

[51] Int. Cl.[6] ..... G03G 21/20

[52] U.S. Cl. ..... 399/93; 399/266

[58] Field of Search ..... 355/215, 30, 245, 355/247, 251, 259, 261; 118/651–654, 656, 661; 399/92, 93, 99, 266, 290

[56] References Cited

U.S. PATENT DOCUMENTS

| | | | |
|---|---|---|---|
| 3,894,514 | 7/1975 | Caudill et al. . | |
| 4,666,282 | 5/1987 | Rowe . | |
| 5,089,852 | 2/1992 | Manno et al. | 355/251 |
| 5,146,279 | 9/1992 | Seyfried | 355/215 |
| 5,172,171 | 12/1992 | Beaudet et al. | 355/261 |
| 5,253,016 | 10/1993 | Behe et al. | 355/215 |
| 5,283,617 | 2/1994 | Benedict et al. | 355/253 |

*Primary Examiner*—Robert Beatty
*Attorney, Agent, or Firm*—Lloyd F. Bean II

[57] ABSTRACT

An apparatus for developing a latent image recorded on a surface with toner. The apparatus includes a housing having a supply of toner therein; a donor member arranged in said housing to transport toner to a development zone adjacent the surface; a electrode member is provided for detaching toner from said donor member and produce a toner cloud in the development zone; and an air handling system, associated with said housing, for collecting stray toner particles emitted from said housing, said air handling system including a separator for separating toner by size. The air handling system includes a blower, a particle chamber and a valve assembly.

4 Claims, 3 Drawing Sheets

AIR HANDLING SYSTEM FOR A DEVELOPMENT HOUSING

BACKGROUND OF THE INVENTION

This invention relates generally to the development of electrostatic images, and more particularly concerns a scavengeless development system having a air handling system which allows a steady flow of air into a development housing and prevent toner emission therefrom.

INCORPORATION BY REFERENCE

The following is specifically incorporated by reference U.S. Pat. No. 08/671,390 entitled "AIR HANDLING SYSTEM FOR A DEVELOPMENT HOUSING" filed concurrently herewith.

The invention can be used in the art of electrophotographic printing. Generally, the process of electrophotographic printing includes sensitizing a photoconductive surface by charging it to a substantially uniform potential. The charge is selectively dissipated in accordance with a pattern of activating radiation corresponding to a desired image. The selective dissipation of the charge leaves a latent charge pattern that is developed by bringing a developer material into contact therewith. This process forms a toner powder image on the photoconductive surface which is subsequently transferred to a copy sheet. Finally, the powder image is heated to permanently affix it to the copy sheet in image configuration.

Two component and single component developer materials are commonly used. A typical two component developer material comprises magnetic carrier granules having toner particles adhering triboelectrically thereto. A single component developer material typically comprises toner particles having an electrostatic charge so that they will be attracted to, and adhere to, the latent image on the photoconductive surface.

There are various known development systems for bringing toner particles to a latent image on a photoconductive surface. Single component development systems use a donor roll for transporting charged toner to the development nip defined by the donor roll and the photoconductive surface. The toner is developed on the latent image recorded on the photoconductive surface by a combination of mechanical scavengeless development. A scavengeless development system uses a donor roll with a plurality of electrode wires closely spaced therefrom in the development zone. An AC voltage is applied to the wires detaching the toner from the donor roll and forming a toner powder cloud in the development zone. The electrostatic fields generated by the latent image attract toner from the toner cloud to develop the latent image. In another type of scavengeless system, a magnetic developer roll attracts developer from a reservoir. The developer includes carrier and toner. The toner is attracted from the carrier to a donor roll. The donor roll then carries the toner into proximity with the latent image. A problem with the scavengeless development housing is the emission of toner into the machine cavity at the development nip which leads to copy defects.

BRIEF SUMMARY OF THE INVENTION

In accordance with one aspect of the present invention, there is provided an electrophotographic printing machine of the type in which an electrostatic latent image recorded on a charge retentive surface is developed with toner particles to form a visible image thereof, including: a housing having a supply of toner therein; a donor member arranged in said housing to transport toner to a development zone adjacent the surface; an air handling system, associated with said housing, for collecting stray toner particles emitted from said housing; and an air lock system, operatively connected to said air handling system, for maintaining air pressure in said housing while allowing toner particles to pass therethrough to said housing.

Another aspect of the invention there is provided an apparatus for developing a latent image recorded on a surface including: a housing having a supply of toner therein; a donor member arranged in said housing to transport toner to a development zone adjacent the surface; an air handling system, associated with said housing, for collecting stray toner particles emitted from said housing; and an air lock system, operatively connected to said air handling system, for maintaining air pressure in said housing while allowing toner particles to pass therethrough to said housing.

Other features of the present invention will become apparent as the following description proceeds and upon reference to the drawings.

DETAILED DESCRIPTION OF THE PREFERRED EMBODIMENT OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Figure 1:
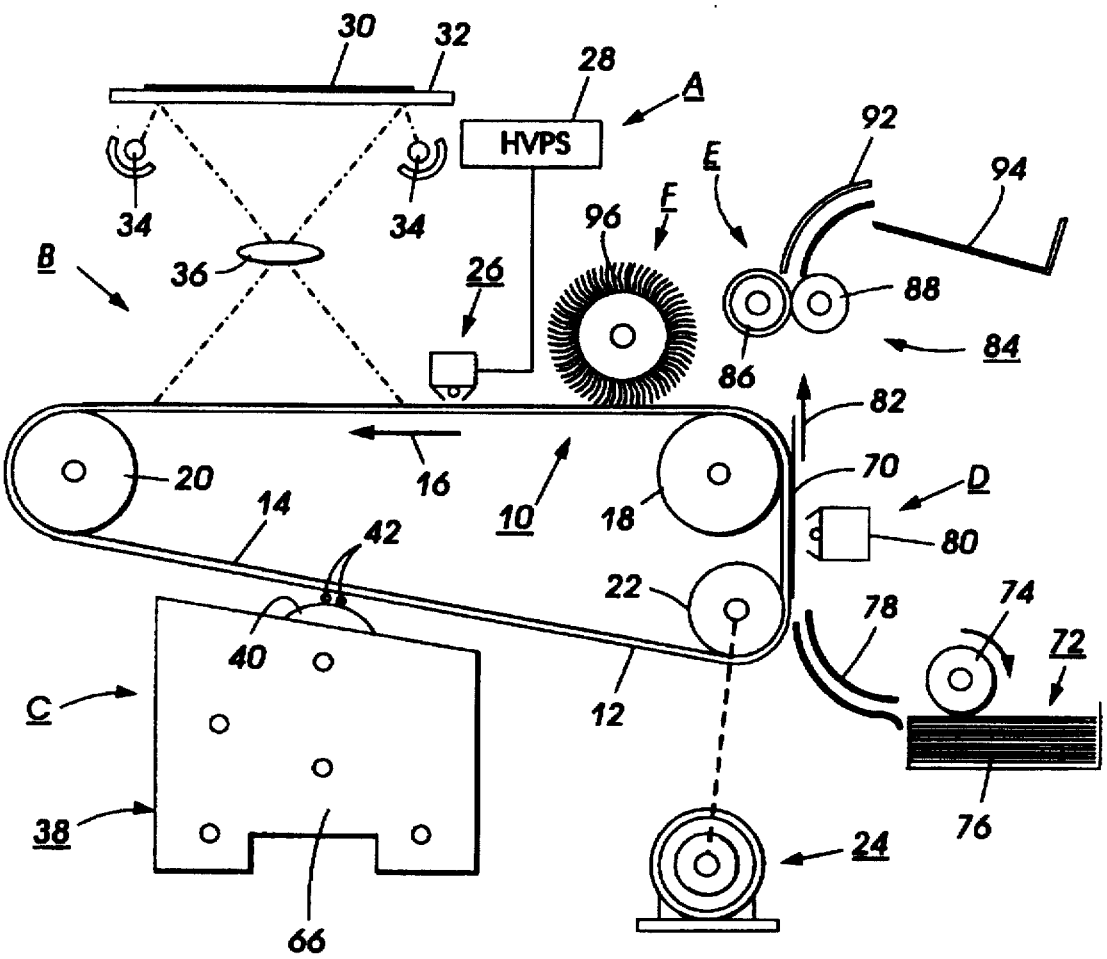
FIG. 1 is a schematic elevational view of an illustrative electrophotographic printing machine incorporating a developer unit having the features of the present invention therein.

Referring initially to FIG. 1, there is shown an illustrative electrophotographic printing machine incorporating the development apparatus of the present invention therein. The electrophotographic printing machine employs a belt 10 having a photoconductive surface 12 deposited on a conductive substrate 14. Preferably, photoconductive surface 12 is made from selenium alloy. Conductive substrate 14 is made preferably from an aluminum alloy that is electrically grounded. One skilled in the art will appreciate that any suitable photoconductive belt may be used. Belt 10 moves in the direction of arrow 16 to advance successive portions of photoconductive surface 12 sequentially through the various processing stations disposed of throughout the path of movement thereof. Belt 10 is entrained about stripping roller 18, tensioning roller 20 and drive roller 22. Drive roller 22 is mounted rotatably in engagement with belt 10. Motor 24 rotates roller 22 to advance belt 10 in the direction of arrow 16. Roller 22 is coupled to motor 24 by suitable means, such as a drive belt. Belt 10 is maintained in tension by a pair of springs (not shown) resiliently urging tensioning roller 20 against belt 10 with the desired spring force. Stripping roller 18 and tensioning roller 20 are mounted to rotate freely.

Initially, a portion of belt 10 passes through charging station A. At charging station A, a corona generating device, indicated generally by the reference numeral 26 charges photoconductive surface 12 to a relatively high, substantially uniform potential. High voltage power supply 28 is coupled to corona generating device 26 to charge photoconductive surface 12 of belt 10. After photoconductive surface 12 of belt 10 is charged, the charged portion thereof is advanced through exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses this light image onto the charged portion of photoconductive surface 12 to selectively dissipate the charge thereon. This records an electrostatic latent image on photoconductive surface 12 that corresponds to the informational areas contained within original document 30.

After the electrostatic latent image has been recorded on photoconductive surface 12, belt 10 advances the latent image to development station C. At development station C, a developer unit, indicated generally by the reference numeral 38, develops the latent image recorded on the photoconductive surface. Preferably, developer unit 38 includes donor roll 40 and electrode wires 42. Electrode wires 42 are electrically biased relative to donor roll 40 to detach toner therefrom so as to form a toner powder cloud in the gap between the donor roll and the photoconductive surface. The latent image attracts toner particles from the toner powder cloud forming a toner powder image thereon. Donor roll 40 is mounted, at least partially, in the chamber of developer housing 66. The chamber in developer housing 66 stores a supply of developer material. In one embodiment the developer material is a single component development material of toner particles, whereas in another the developer material includes at least toner and carrier.

With continued reference to FIG. 1, after the electrostatic latent image is developed, belt 10 advances the toner powder image to transfer station D. A copy sheet 70 is advanced to transfer station D by sheet feeding apparatus 72. Preferably, sheet feeding apparatus 72 includes a feed roll 74 contacting the uppermost sheet of stack 76 into chute 78. Chute 78 directs the advancing sheet of support material into contact with photoconductive surface 12 of belt 10 in a timed sequence so that the toner powder image developed thereon contacts the advancing sheet at transfer station D. Transfer station D includes a corona generating device 80 which sprays ions onto the back side of sheet 70. This attracts the toner powder image from photoconductive surface 12 to sheet 70. After transfer, sheet 70 continues to move in the direction of arrow 82 onto a conveyor (not shown) that advances sheet 70 to fusing station E.

Fusing station E includes a fuser assembly, indicated generally by the reference numeral 84, which permanently affixes the transferred powder image to sheet 70. Fuser assembly 84 includes a heated fuser roller 86 and a back-up roller 88. Sheet 70 passes between fuser roller 86 and back-up roller 88 with the toner powder image contacting fuser roller 86. In this manner, the toner powder image is permanently affixed to sheet 70. After fusing, sheet 70 advances through chute 92 to catch tray 94 for subsequent removal from the printing machine by the operator.

After the copy sheet is separated from photoconductive surface 12 of belt 10, the residual toner particles adhering to photoconductive surface 12 are removed therefrom at cleaning station F. Cleaning station F includes a rotatably mounted fibrous brush 96 in contact with photoconductive surface 12. The particles are cleaned from photoconductive surface 12 by the rotation of brush 96 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 2:
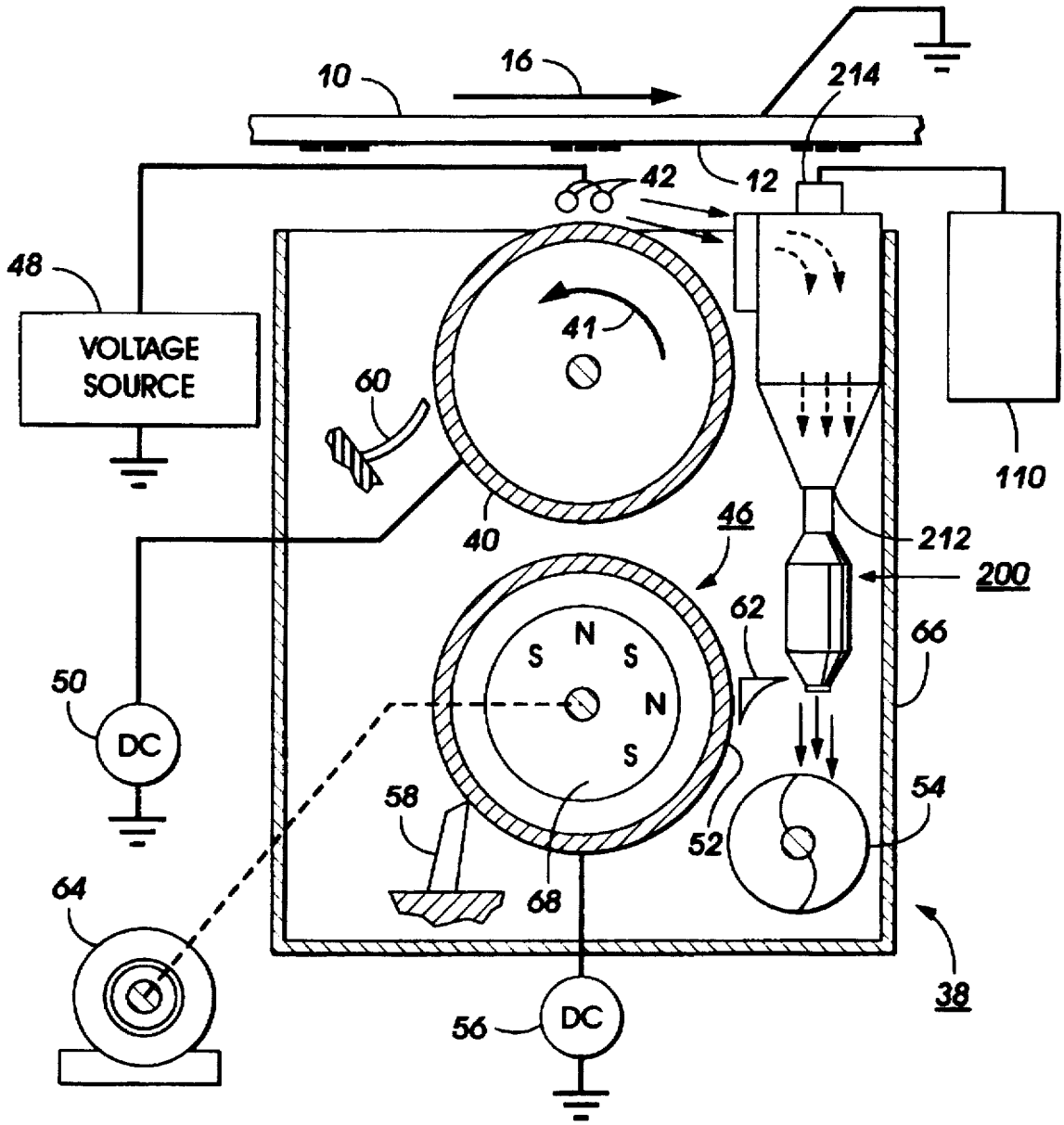
FIG. 2 is a schematic elevational view showing one embodiment of the developer unit used in the FIG. 1 printing machine.

Referring now to FIG. 2, there is shown one embodiment of the present invention in greater detail. The development system 38 includes a donor roll 40, electrode wires 42, and metering and charging roll 46. The donor roll 40 attracts toner from the reservoir and roll 46 charges the toner and meters the quantity on the donor roll. The donor roll 40 can be rotated in either the 'with' or 'against' direction relative to the direction of motion of belt 10. The donor roll is shown rotating in the direction of arrow 41. The metering and charging roll 46 may comprise any suitable device for metering and charging the toner. For example, it may comprise an apparatus such as described in U.S. Pat. No. 4,459,009 wherein the contact between weakly charged toner particles and a triboelectrically active coating contained on a charging roll results in well charged toner. Other combination metering and charging devices may also be employed.

The developer apparatus 38 further has electrode wires 42 located in the space between photoconductive surface 12 and donor roll 40, as described in U.S. Pat. No. 4,868,600. The electrode wires 42 include one or more thin tungsten wires which are lightly positioned against the donor roll 40. The distance between the wires 42 and the donor roll 40 is approximately the thickness of the toner layer on the donor roll 40. The extremities of the wires are supported by the tops of end bearing blocks (not shown) which also support the donor roll 40 for rotation.

An electrical bias is applied to the electrode wires by a voltage source 48. The bias establishes an electrostatic field between the wires 42 and the donor roll 40 which is effective in detaching toner from the surface of the donor roll 40 and forming a toner cloud about the wires 42, the height of the cloud being such as not to contact with the photoconductive surface 12.

A DC bias supply 50 establishes an electrostatic field between the photoconductive surface 12 and the donor roll 40 for attracting the detached toner particles from the cloud surrounding the wires 42 to the latent image on the photoconductive surface 12.

Invariably a small amount of toner particles escape the confines of the cloud, cyclone separator 200 collects the escaping toner particles. Cyclone separator 200 of the present invention can be molded or mount into housing 102. Cyclone separator 200 allows a steady stream of air into the housing preventing emission of toner therefrom into the machine cavity. Referring to FIG.2 cyclone separator 200 separates the collected toner particles in a stream of air using centriple force into two particle classes desired sized toner and undesired sized toner. Blower 110 is attached to air exit 214. Blower 110 generates a vacuum which removes the lighter undesired tuner through air exit 214. Blower 110 generates a slight vacuum, preferably (2 inches water) air is drawn into the housing from the donor roll-development nip area and into cyclone separator 200 where toner is removed from the air stream and retained inside the housing. An advantageous feature of the present invention is that small sized toner (below 2 microns) which may degrade development can be eliminated through via air exit 214 while desire sized toner (3–8 microns) can be returned through exit 212 to the housing to be reused.

Figure 3:
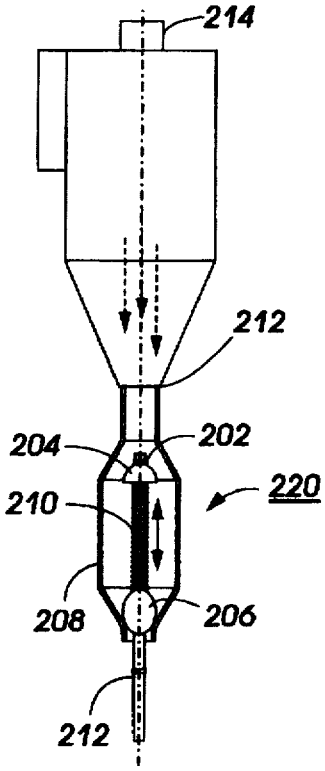
FIGS. 3 and 4 are schematic elevational views showing an air lock system of the present invention.
Figure 4:
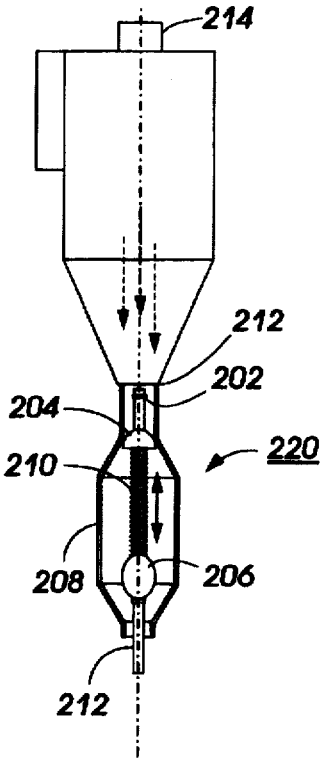

Referring to FIG. 3 and 4, it is preferred to have an air locking system 220 connected to exit 212 to ensure that pressure generated by cyclone separator 200 does not disturb the toner within the housing. Air locking system 220 consist of a particle chamber 208 with a one way valve assembly to move the toner from chamber 208 back into housing 44. One way valve assembly consist of elastomer seals 204 and 206 connect to rod 202 with a compression spring 210 therebetween in the manner as shown. In operation a motor (not shown) moves rod 202 in a periodic linear motion, as rod moves down seal 206 becomes engaged with a bottom neck portion of particle chamber establishing an air tight seal as seal 204 opens allowing toner particles to collect in particle chamber 208. After period of time, the rod moves up and seal 204 becomes engaged with a top neck portion of particle chamber establishing an air tight seal as seal 206 opens allowing toner particles to fall into the housing.

Before the transfer of toner from the magnetic roll 48 to the donor roll 40, a cleaning blade 60 strips all of the toner from donor roll 40 so that magnetic roll 46 meters fresh toner to a clean donor roll. Then a DC bias supply 56 establishes an electrostatic field between magnetic roll 46 and donor roll 40 which causes toner particles to be attracted from the magnetic roll to the donor roll. Metering blade 62 is positioned closely adjacent to magnetic roll 46 to maintain the compressed pile height of the developer material on magnetic roll 48 at the desired level.

Magnetic roll 46 includes a non-magnetic tubular member or sleeve 52 made preferably from aluminum and having the exterior circumferential surface thereof roughened. An elongated multiple magnet 68 is positioned interiorly of and spaced from the tubular member. Elongated magnet 68 is mounted on bearings and coupled to motor 64. Tubular member 52 may also be mounted on suitable bearings and coupled to motor 64. Toner particles are attracted from the carrier granules on the magnetic roll to the donor roll. Scraper blade 58 removes denuded carrier granules and extraneous developer material from the surface of tubular member 52.

As successive electrostatic latent images are developed, the toner particles within the developer material are depleted. Augers 54 are mounted rotatably to mix fresh toner particles with the remaining developer material so that the resultant developer material therein is substantially uniform with the concentration of toner particles being optimized.

It is, therefore, apparent that there has been provided in accordance with the present invention that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An electrophotographic printing machine of the type in which an electrostatic latent image recorded on a charge retentive surface is developed with toner particles to form a visible image thereof, comprising:

a housing having a supply of toner therein;

a donor member arranged in said housing to transport toner to a development zone adjacent the surface;

an air handling system, associated with said housing, for collecting stray toner particles emitted from said housing; and an air lock system, operatively connected to said air handling system, for maintaining air pressure in said housing while allowing toner particles to pass therethrough to said housing said air lock system comprises:

a particle chamber for holding toner exiting from said air handling system; and a valve assembly having a first mode for providing a first air tight seal between said air handling system and said particle chamber to move the toner from said chamber back into housing and said valve assembly having a second mode providing a second air tight seal between the housing and said chamber to allow toner to collect in said chamber.

2. The electrophotographic printing machine according to claim 1, wherein said valve assembly comprises:

a seal, disposed in said chamber, for providing said first air tight seal between said air handling system and said particle chamber and providing said second air tight seal between the housing and said chamber; and means for moving said seal in said chamber from said air handling system to said housing.

3. An apparatus for developing a latent image recorded on a surface, comprising:

a housing having a supply of toner therein;

a donor member arranged in said housing to transport toner to a development zone adjacent the surface;

an air handling system, associated with said housing, for collecting stray toner particles emitted from said housing; and an air lock system, operatively connected to said air handling system, for maintaining air pressure in said housing while allowing toner particles to pass therethrough to said housing said air lock system comprises:

a particle chamber for holding toner exiting from said air handling system; and a valve assembly having a first mode for providing a first air tight seal between said air handling system and said particle chamber to move the toner from said chamber back into housing and said valve assembly having a second mode providing a second air tight seal between the housing and said chamber to allow toner to collect in said chamber.

4. The apparatus according to claim 3, wherein said valve assembly comprises:

a seal, disposed in said chamber, for providing said first air tight seal between said air handling system and said particle chamber and providing said second air tight seal between the housing and said chamber; and means for moving said seal in said chamber from said air handling system to said housing.

* * * * *